US009339811B2

(12) United States Patent
Schmidt

(10) Patent No.: US 9,339,811 B2
(45) Date of Patent: May 17, 2016

(54) MULTI-CHANNEL PIPETTE

(71) Applicant: Eppendorf AG, Hamburg (DE)

(72) Inventor: Peter Schmidt, Luebeck (DE)

(73) Assignee: Eppendorf AG, Hamburg (DE)

( * ) Notice: Subject to any disclaimer, the term of this patent is extended or adjusted under 35 U.S.C. 154(b) by 260 days.

(21) Appl. No.: 14/087,542

(22) Filed: Nov. 22, 2013

(65) Prior Publication Data

US 2014/0147349 A1 May 29, 2014

Related U.S. Application Data

(60) Provisional application No. 61/729,466, filed on Nov. 23, 2012.

(30) Foreign Application Priority Data

Nov. 23, 2012 (EP) ..... 12007916

(51) Int. Cl.
*B01L 3/02* (2006.01)

(52) U.S. Cl.
CPC ..... *B01L 3/0279* (2013.01); *B01L 2200/0605* (2013.01); *B01L 2200/087* (2013.01)

(58) Field of Classification Search
CPC .... B01L 3/0234; B01L 3/0237; B01L 3/0193
USPC ..... 422/515, 518, 522; 73/1.74
See application file for complete search history.

(56) References Cited

U.S. PATENT DOCUMENTS 5,021,217 A * 6/1991 Oshikubo ..... B01L 3/0217 422/516
6,968,749 B2 * 11/2005 Chen ..... B01L 3/0227 422/561
7,947,234 B2 * 5/2011 O'Connell ..... B01L 3/0217 422/501
8,011,257 B2 * 9/2011 Kneucker ..... B01L 3/0217 73/864.17
2005/0155439 A1 * 7/2005 Belgardt ..... B01L 3/0279 73/864.01
2009/0274587 A1 * 11/2009 Butz ..... B01L 3/0217 422/400
2011/0268628 A1 * 11/2011 Warhurst ..... B01L 3/0234 422/511

FOREIGN PATENT DOCUMENTS

WO 98/20973 5/1998

* cited by examiner

*Primary Examiner* — Jill Warden
*Assistant Examiner* — Brittany Fisher
(74) *Attorney, Agent, or Firm* — Vidas, Arrett & Steinkraus, P.A.

(57) ABSTRACT

A multichannel pipette with a base body, several spigots for clamping up pipette tips, arranged parallel side by side in a row, protruding from the base body and mounted on the base body so as to be movable in their longitudinal direction, at least one displacement equipment with a displacement chamber and a displacement member dislocatable therein, wherein the displacement chamber is connected to connection holes in the spigots in order to eject or aspirate air through openings of the connection holes in lower ends of the spigots, a first drive device, connected to the displacement member and adapted to dislocate the displacement member in the displacement chamber, first spring elements, engaging on the spigots and on the base body, wherein the spigots are dislocatable upward in their longitudinal direction from a starting position against the spring action of the first spring elements.

16 Claims, 16 Drawing Sheets

MULTI-CHANNEL PIPETTE

CROSS-REFERENCE TO RELATED APPLICATIONS

This application claims priority to 61/729,466 filed on Nov. 23, 2012

STATEMENT REGARDING FEDERALLY SPONSORED RESEARCH

Not applicable.

BACKGROUND OF THE INVENTION

The present invention relates to a multichannel pipette with several spigots ("lugs") for clamping up pipette tips and an ejection equipment for detaching pipette tips from spigots.

Pipettes are used for dosing liquids, notably in medical, biological, biochemical, chemical and other laboratories. The liquids are picked up and delivered in pipette tips through a tip opening. In air cushion pipettes, a displacement equipment for air is integrated into the pipette and communicatingly connected to the pipette tip through a connection hole of the spigot. An air cushion can be dislocated by means of the displacement equipment, so that liquid is sucked into the pipette tip and ejected out from there. The displacement equipment is mostly a cylinder with a piston that can be relocated therein.

The pipette tips are detachably connected to the spigot, so that they can be replaced by a new pipette tip after use. Through this, contaminations are avoided in subsequent dosings. Single use pipette tips made of plastics are available at low cost.

The spigot for holding pipette tips is also designated as "working cone" and is often a conical or cylindrical projection with respect to a casing or another base body. The pipette tip can be clamped up onto the spigot with a suitable seal seat on a plug-on opening. This can happen without touching the pipette tip by pressing the pipette with the spigot into the plug-opening of the pipette tip which is made available in a holder.

In order to avoid contact of the user with the contaminated pipette tips, pipettes have an ejection equipment with a drive device and an ejector. By actuating the drive device, the ejector is dislocated such that it detaches the pipette tip from the spigot without that the user must touch it. The drive device has often a mechanism which must be actuated by means of a button in order to detach the pipette tip from the spigot. Alternatively, the drive device has an electric motor which can be controlled by actuating a button in order to detach the pipette tip from the spigot. This applies in particular for manual pipettes, i.e. pipettes which are can be held and operated by the user with one or both hands in the utilization. In the embodiment as manually driven pipettes, these pipettes have a mechanism for the displacement equipment which is manually drivable by means of a dosing button, and in the embodiment as electronic pipettes an electric drive motor for the displacement equipment which can be controlled by means of an electric dosing button.

Detaching a pipette tip from the spigot can necessitate a significant effort when a pipette tip is to be firmly clamped up on a spigot.

Multichannel pipettes serve for picking up liquid from one or several vessels or to deliver into one or several vessels concomitantly. Multichannel pipettes are often used for the handling of microtiter plates, which have a plurality of vessels in a matrix-like arrangement. For this purpose, multichannel pipettes have several spigots, arranged parallel side by side in a row in the same height, whose through holes are each one connected to a separate displacement equipment or to a common displacement equipment. In adaptation to a frequently used format of microtiter plates with 96 (=8×12) vessels, multichannel pipettes have frequently eight or twelve spigots. The several displacement equipments or the common displacement equipment are connected to a mechanical drive device in a manually driven multichannel pipette, and to an electric drive motor in an electronic multichannel pipette. Further known are multichannel pipettes with an ejector, which squeezes all pipette tips off from the spigot by a straight-lined stop element and has a manually drivable drive mechanism for this purpose. The expense for squeezing off several pipette tips from the spigots of a multichannel pipette is significantly higher than in a single-channel pipette wherein only one pipette tip is squeezed off from one spigot.

Multichannel pipettes are already known in which, in order to reduce the effort for ejecting the pipette tips, an ejector is not realised by a straight-lined stop element, but with a stepped stop element. In these multichannel pipettes, the steps hit the pipette tips one after the other, so that only the force must be applied for ejecting those pipette tips which have contact with steps of the ejector at the same time. The maximum force to be brought up for the ejection of the pipette tips is reduced through this. A stepped stop element results in different plug-on heights of the pipette tips on spigots of a multichannel pipette. With different plug-on heights, not all the pipette tips which are plugged onto the spigots of the multichannel pipette at the same time do reach the bottoms of a microtiter plate.

The document DE 10 2004 003 433 B4, the entire contents of which is incorporated herein by reference, describes a multichannel pipette which reduces the effort for the actuation of the ejection equipment in that it limits the force for clamping the pipette tips onto the spigots. For this purpose, the multichannel pipette has a base body, several spigots projecting from the base body and axially movably mounted on the base body for putting up pipette tips, displacement equipments which are fixedly connected to the spigots, and springs via which the displacement equipments are supported on the base body. A stop is associated to the spring loaded spigots beyond which the spigots protrude axially when they are not loaded towards the spring. An ejection equipment for detaching the pipette tips from the spigots has an ejector associated to the spigots, wherein the spigots and the ejectors are movable relative to each other. The stop may also be the ejector. In addition, the multichannel pipette has a drive device, operatively connected to the ejector and/or the spigots, for relative movement of ejector and spigot.

When the multichannel pipette is being plugged into the plug-in openings of several pipette tips with the spigots, the clamping force is introduced into the springs. When the clamping force exceeds a certain value, the springs are elastically deformed until the pipette tips clamped onto the spigots butt against the stop. As soon as the pipette tips abut on the stop, they cannot be thrust onto the spigots any farther. The clamping force of the pipette tips is limited by this. The springs are dimensioned such, and preloaded if need be, that the pipette tips abut on the stop accurately then when they sit on the spigots with the desired clamping force. The clamping force is determined such that the pipette tips sit and seal securely on the spigots.

The known pipette avoids high clamping forces, which would hamper the ejection of the pipette tips. However, the clamping force which is necessary for a safe seat and the sealing of the pipette tips on the spigots must be overcome in the ejection process. The overall ejection force to be applied is high, because several pipette tips must be squeezed off at the same time.

BRIEF SUMMARY OF THE INVENTION

Starting from this, the present invention is based on the task to provide a multichannel pipette which further reduces the effort for the actuation of the ejection equipment.

The multichannel pipette of the present invention has a base body, several spigots for clamping up pipette tips, arranged parallel side by side in a row, protruding from the base body and mounted on the base body so as to be movable in their longitudinal direction, at least one displacement equipment with a displacement chamber and a displacement member dislocatable therein, wherein the displacement chamber is connected to connection holes in the spigots in order to eject or aspirate air through openings of the connection holes in lower ends of the spigots, a first drive device, connected to the displacement member and adapted to dislocate the displacement member in the displacement chamber, first spring elements engaging on the spigots and on the base body, wherein the spigots are dislocatable upward in their longitudinal direction from a starting position against the spring action of the first spring elements, at least one stop element, having a defined stop position in which the spigots protrude downward from the stop element, wherein the first spring elements are designed such that by defined clamping forces which can be applied by clamping up pipette tips onto the spigots, the spigots can be dislocated towards the stop element in the stop position in such a way that the pipette tips hit the stop element, and an ejection equipment for detaching pipette tips from the spigots, comprising an ejector, which comprises contact elements, means for slidably mounting the ejector on the base body so as to be slidable in the longitudinal direction of the spigots, and a drive device connected to the ejector which is adapted to dislocate the ejector downward in the longitudinal direction of the spigots from out a starting position, in which pipette tips can be clamped up onto the spigots until they strike the stop element in the stop position, in order to squeeze pipette tips off from the spigots by the contact elements, wherein the ejector has the contact elements on different ejector parts and is designed such that in the downward dislocation of the ejector, at least after the impact of at least one first contact element on pipette tips, at least one second contact element pursues the first contact element in order to squeeze one or several pipette tips off from the spigots by the first contact element at first, and thereafter one or several pipette tips by the second contact element.

In the multichannel pipette of the present invention, the clamping forces for clamping up pipette tips are limited in that the spigots are dislocated towards the at least one stop element by the clamping forces acting on them when pipette tips are being clamped up, until the pipette tips hit the stop element which is in a defined stopping position. In case that the multichannel pipette has several stop elements, these are in the same height in the stopping position. The first spring elements are dimensioned such that the pipette tips impinge on the stop element when defined clamping forces are reached. These are preferably selected such that the pipette tips sit safely and sealingly on the spigots. High clamping forces, which would have to be overcome in the ejection of the pipette tips, are avoided. In this multichannel pipette, the utilization of an ejector with stop elements arranged in steps would not make sense, because this geometry favours different plug-on heights of the pipette tips, which are accompanied by different clamping forces. However, the multichannel pipette of the present invention permits to clamp up several pipette tips with defined clamping force, and a reduction of the maximum force for ejecting the pipette tips. For this purpose, the multichannel pipette has several contact elements on different ejector parts. When pipette tips are being plugged on, all the contact elements are in a defined starting position, which permits that all pipette tips can be clamped onto the spigots with a defined clamping force until they impinge on the stop element. The ejector is designed such that when the ejector is being downward dislocated, a second contact element pursues the first contact element at least after the impact of a first contact element on pipette tips. This has the consequence that one or several pipette tips are squeezed off from the spigots by the first contact element at first, and that one or several pipette tips are squeezed off from the spigots by the second contact element only thereafter. Through this, the maximum force for the ejection of the pipette tips is reduced even in the multichannel pipette of the present invention. The multichannel pipette has preferably only first and second contact elements on first and second ejector parts. Moreover, the present invention incorporates embodiments which comprise more than two ejector parts with at least one contact element at a time, wherein the contact element of a further (a third e.g.) ejector part pursues the contact element of the antecedent one (the second e.g.) at least after the impact on pipette tips thereof.

The multichannel pipette has preferably coincidentally formed spigots, which are arranged in the same height in their starting position. The spigots are preferably formed coincidentally with respect to shape and dimensions. Further preferably, the first spring elements of the multichannel pipette are designed coincidentally. Further preferably, the first spring elements are preloaded when the spigots are in the starting position. The displacement equipment is preferably a piston-cylinder-assembly, wherein the displacement chamber is a cylinder and the displacement member is a piston which is dislocatable in the cylinder.

According to one embodiment of the present invention, the first and second ejector parts are board-shaped, the first contact element is at least one first bar, protruding horizontally from the lower edge of the first ejector part and having one or plural first through hole(s), the second contact element is at least one second bar, protruding horizontally from the lower edge of the second ejector part and having one or plural second through hole(s), and the spigots penetrate the first and second through holes. Via the board-shaped first and second ejector parts and the first and second contact elements which are formed as bars, the ejection force can be applied to one or several pipette tips on which the first contact element sits, and to one or several pipette tips on which the second contact element sits subsequently. Through this embodiment, the ejector part can be housed in a narrow, box-shaped pipette lower part (called also "delivery head) of the multichannel pipette.

According to a further embodiment, the ejector has a first ejector part which is connected to the drive device, and a second ejector part, wherein the first ejector part and the second ejector part are guided by means for guiding so as to be dislocatable relative to each other in the longitudinal direction of the spigots, the first ejector part with the first contact element and the second ejector part with the second contact element are arranged in the same height in the starting position of the ejector, and first take-along means exist on the first ejector part as well as second take-along means on the second ejector part, which are spaced apart from each other in the starting position of the ejector and can be moved against each other along the means for guiding in the downward dislocation of the ejector by dislocation of the first ejector part and the second ejector part relative to each other, in order to dislocate the second ejector part downward synchronously with the first ejector part when the first and the second take-along means hit each other.

In the starting position, the first and second take-along means of the ejector are in a distance from each other. In the downward dislocation of the ejector, the first and the second ejector part are dislocatable relative to each other in the longitudinal direction of the spigots. The dislocation of the ejector parts with respect to each other is limited by the impingement of the first and second take-along means on each other. When the first contact element impinges on the pipette tips in the downward dislocation of the ejector, the second contact element is prevented from a further downward dislocation by the pipette tips at first. As a consequence, only the first ejector part continues the downward dislocation and squeezes pipette tips off from the lugs. In this, the first ejector part is dislocated relative to the second ejector part, until the first take-along means hit the second take-along means. Thereafter, the first ejector part takes the second ejector part downward along, which squeezes pipette tips off from the spigots by the second contact element. Thus, several pipette tips ore several groups of pipette tips are consecutively ejected from the spigots and the maximum force for ejecting the pipette tips is reduced.

In this embodiment, the contact elements are in the same height in the starting position of the ejector. Through this, the contact elements can be used as stop elements at the same time. According to a preferred further embodiment, the contact elements are the stop elements at the same time and occupy the stopping position in the starting position of the ejector.

According to one embodiment, the distance between the first and second take-along means in the vertical direction is 0.1 to 3 mm, preferably 0.5 to 1.5 mm in the starting position of the ejector. This distance is sufficient for squeezing off different pipette tips or different groups of pipette tips subsequently by means of the ejector, and it can be realised without sensibly increasing the ejection stroke.

According to a further embodiment, the first ejector part has a first deepening on its lower edge with first guide elements on two lateral edges, and the second ejector part is inserted into the first deepening of the first ejector part and is dislocatable in the longitudinal direction of the spigots on second guide elements on two lateral edges on the first guide elements of the first ejector part. The first and second ejector parts are preferably board-shaped in this. By guiding the second ejector part on two lateral edges of the first deepening, it is ensured that the second ejector part is smoothly dislocatable with respect to the first ejector part.

According to a further embodiment, the first take-along means are formed by the upper edge of the deepening, and the second take-along means are formed by the upper edge of the second ejector part. The second ejector part is dislocatable into the deepening until it hits the upper edge of the deepening with its upper edge.

According to a further embodiment, the second ejector part is held on the first ejector part by connection means which have a clearance in the longitudinal direction of the spigots. The second ejector part is undetachably connected to the first ejector part by the connection means, so that it cannot release itself from the bottom side of the multichannel pipette. According to a further embodiment, the connection means are snap connection means. The connection of the ejector parts by (snap-) connection means is advantageous for the mounting.

According to a further embodiment, the snap connection means have an eyelet on the first ejector part, and a snap hook engaging with clearance in the direction of the spigots into the eyelet on the second ejector part or vice versa. By these snap connection means, the snap connection can be implemented particularly simply and safely.

The first ejector part and the second ejector part preferably each consist of a rigid material. Preferably, they consist of a plastic material, further preferably of a thermoplastic material.

In an embodiment which is an alternative to the ejector with ejector parts guided so as to be dislocatable relative to each other, the ejector has a rigid first ejector part and an at least partially rigid second ejector part, and the first ejector part with the first contact element and the second ejector part with the second contact element are arranged in the same height in the starting position of the ejector. When the ejector parts hit the pipette tips with the contact elements, the rigid first ejector part squeezes pipette tips off from spigots at first, and the soft-elastic second ejector part is at least partially blocked and elastically compressed by pipette tips at first. Only when the force for compressing the at least partially soft-elastic second ejector part exceeds the force for ejecting the pipette tips which sit snugly on the second contact element, these pipette tips will be ejected. The maximum force for ejecting pipette tips is reduced even through this.

In that the contact elements are in the same height in the starting position of the ejector, they can be used as stop elements at the same time. According to a preferred further embodiment, the contact elements are the stop elements at the same time, and the contact elements occupy the stopping position in the starting position of the ejector.

According to one embodiment, the second ejector part is separated on both sides from the first ejector part, for instance by gaps or slots. In this embodiment, the elastic compression of the second ejector part is not hindered by a connection to the first ejector part on the two longitudinal sides of the second ejector part.

According to one embodiment, the second ejector part is elastic as a whole. According to a preferred embodiment, the second ejector part is soft elastic in only one or plural sections, and rigid for the rest. According to a preferred embodiment, the soft elastic section extends preferably parallel to the second contact element, so that the second ejector part is elastically compressed when the second contact element presses against the upper ends of pipette tips. The elastic deformation is concentrated to the soft elastic section of the second ejector part.

According to one embodiment, the second contact element is a soft elastic section of the second ejector part. According to a preferred embodiment, the second contact element is formed on a rigid section of the second ejector part, and the second ejector part has the soft elastic section in a distance from the second contact element. According to a preferred embodiment, the second ejector part is connected to the rigid first ejector part or supported on the same via a soft elastic section. According to a further embodiment, the rigid section of the second ejector part below the soft elastic section of the second ejector part is guided so as to be dislocatable on the first ejector part by means for guiding in the longitudinal direction of the spigots. According to a further embodiment, the rigid section of the second ejector part is guided on second guide elements on two laterals edges on first guide elements of the first ejector part, so as to be dislocatable in the longitudinal direction of the spigots.

According to a preferred embodiment, in a multichannel pipette with a rigid first ejector part and an at least partially soft elastic second ejector part, the second ejector part is arranged in a deepening on the lower edge of the first ejector part, being fixedly connected to the upper edge of the deepening on its upper edge via a soft elastic section.

According to one embodiment, the at least partially soft elastic second ejector part is alternatively connected to the first ejector part on its upper edge via a snap connection or via another detachable or non-detachable connection.

The rigid first ejector part consists preferably of a rigid plastic material, and/or the soft elastic second ejector part as a whole or at least partially of an elastomer. Further preferred, the first ejector part consists of a thermoplast, and/or the second ejector part as a whole or at least partially of a thermoplastic elastomer, a silicone elastomer or of latex. According to a further embodiment, the second ejector part partially consists of a thermoplast. A second ejector part, which has at least one soft elastic section and at least one rigid section, is preferably produced from two plastics components in the two-component- or in the multi-component moulding process.

According to another embodiment, the second ejector part is connected to the first ejector part via a soft elastic section. The fixedly connected second and first ejector parts can be produced in the two-component- or in the multi-component moulding process.

According to a further embodiment, the means for dislocatable mounting of the ejector have at least one guide slot in the ejector, extending in the longitudinal direction of the spigots, and at least one guide element, fixedly connected to the base body and engaging into the guide slot. The guide element is preferably a pin, a rib or another projection which engages into the guide slot.

According to another embodiment, in its starting position, the ejector rests with the first and second stop elements or another ejector part on a counter stop element, arranged fixedly on the base body, which prevents the ejector from a dislocation farther upward. Through this, it is ensured that the ejector cannot be dislocated upward beyond its starting position. In case that the contact elements are stop elements at the same time, the counter stop element supports the ejector, so that the contact elements are arranged in the starting position. In addition or instead, the starting position of the ejector can be defined by guide slots in the first and second ejector parts and by pins, ribs or other projections engaging into the guide slots which rest on the lower end of the slots in the starting position. According to a preferred embodiment, the counter stop element is rigid.

According to another embodiment, the counter stop element is a bottom wall of the base body having third through openings, through which the spigots project downward and on which the stop elements rest at the bottom in the starting position. In particular, the counter stop element can be formed by a bottom wall of a casing of the multichannel pipette. High forces can be introduced into the bottom wall and the first and second contact elements when pipette tips are being clamped up.

In an alternative to a multichannel pipette wherein the contact elements of the ejector are stop elements at the same time, the at least one stop element is formed separately from the contact elements of the ejector. The stop element is fixedly arranged on the base body in the defined starting position. The stop element is formed by a bottom wall of the base body which comprises third through openings, through which the spigots project downward. The bottom wall extends only up to a horizontal line which cuts all spigots, so that the third through openings surround the spigots only partially. For instance, the third through openings surround the spigots only up to half, or up to a horizontal straight line which cuts all spigots in the centre. Near to the bottom wall, the ejector with its contact elements is arranged at least in the same height as the bottom wall. The contact elements have preferably first and second through openings which partially surround the spigots on one side. When the ejector is in the starting position, pipette tips can be clamped onto the spigots until they hit the stop element. In order to eject the pipette tips, the ejector is dislocated downward, so that the first stop elements at first and thereafter the second stop elements and possibly thereafter further stop elements squeeze pipette tips off from the spigots. In this embodiment, the ejector can be realised with stop elements which are rigidly arranged in steps. Instead, the ejector can comprise ejector parts that are guided so as to be dislocatable with respect to each other, or one rigid and one soft elastic ejector part.

According to a further embodiment, the ejector is dislocatable downward against the spring action of a second spring element which engages on the ejector and on the base body. The second spring element is preferably preloaded when the ejector is in the starting position. The ejector is automatically dislocated back into the starting position after the ejection by the second spring element. According to an alternative embodiment, the multichannel pipette has means for detachably holding the ejector in the starting position. The means for detachably holding are e.g. catching means which keep the ejector in the starting position. For instance by clamping pipette tips onto the spigots, the ejector is dislocatable by the pipette tips from out a lower end position into the starting position, wherein the ejector is held by the means for detachably holding.

According to a further embodiment, the number of the spigots from which pipette tips can be squeezed off by means of the first contact element is the same as the number of the spigots from which pipette tips can be squeezed off by means of the second contact element. In this subdivision, the ejection forces are uniformly distributed to the first ejector part and the second ejector part.

According to one embodiment, the multichannel pipette has an arbitrary number of spigots for concomitantly holding an arbitrary number of pipette tips. The multichannel pipette has preferably eight or twelve spigots. According to another embodiment, the multichannel pipette has an even multiple of eight spigots or an even multiple of twelve spigots. The spigots of the multichannel pipette are preferably arranged side by side in a row. According to another embodiment, the multichannel pipette comprises several rows with spigots arranged side by side.

According to a further embodiment, pipette tips can be squeezed off from four spigots at a time or from six spigots at a time by means of the first and the second contact element. These multichannel pipettes can hold altogether eight or twelve pipette tips at the same time. This is advantageous for the utilization together with frequently used microtiter plates, which have wells in eight rows and twelve columns. According to a further embodiment, pipette tips from less than four spigots at a time or of more than six spigots at a time can be squeezed off by means of the first and the second contact element. These embodiments can be especially advantageously multichannel pipettes which have less than eight or more than twelve spigots.

According to one embodiment, the multichannel pipette is a manual pipette, i.e. a pipette which can be held and operated with one or both hands by the user in the utilization.

In a manually driven pipette, the first drive device is a mechanical one. It comprises preferably a dosing button and a lifting rod which protrudes from the dosing button at the bottom and is connected to or can be coupled with the displacement member of the displacement equipment. The multichannel pipette is a fixed volume pipette or a pipette with adjustable dosing volume. In a fixed volume pipette, the stroke of the lifting rod is limited in that a circulating bead or other projection on the circumference of the lifting rod hits an upper and a lower stop, whose position in the base body is not adjustable. In a pipette with adjustable dosing volume, the position of at least one of the two stops in the base body can be adjusted. The multichannel pipette has preferably a threaded spindle for dislocating the upper stop, which is screw-fastenable in a nut that is fixedly connected to the base body. The lifting rod is guided through a through channel of the threaded spindle, and the lower end face of the threaded spindle forms the upper stop for the projection on the lifting rod.

In an embodiment of the multichannel pipette as a manually driven multichannel pipette, the second drive device can be actuated by way of the dosing button of the first drive device. After a dosing stroke and an overstroke, the pipette tips are ejected in an ejecting stroke of the dosing button. This embodiment permits dosing and ejection of pipette tips by actuating the same button (so-called "single-button operation").

According to another embodiment, the multichannel pipette has a second drive device with an ejector button which is formed separately from the dosing button (so-called "two-button operation"). Such a manually driven multichannel pipette is described e.g. in the document DE 10 2004 003 433 B4. In this respect, reference is made to DE 10 2004 003 433 B4, whose subject matter is herewith incorporated into this application.

In the realization as an electronic pipette, the multichannel pipette has an electric drive motor and a gear system between drive motor and displacement member, as well as an electronic control system of the drive motor by an electric dosing button. The second drive device of the multichannel pipette is realized for instance such as described in DE 10 2004 003 433 B4. In this respect, reference is made to DE 10 2004 003 433 B4, whose subject matter is herewith incorporated into this application.

The multichannel pipette has preferably a pipette upper part, which comprises the first and second drive devices, and a delivery head which comprises the displacement chambers and the ejector. Preferably, the pipette upper part and the delivery head can be releasably connected one to the other. The means for releasably connecting pipette upper parts and delivery head are realized for instance such as described in DE 10 2004 003 433 B4. In this respect, reference is made to DE 10 2004 003 433 B4, whose subject matter is herewith incorporated into this application.

BRIEF DESCRIPTION OF THE SEVERAL VIEWS OF THE DRAWINGS

The present invention will be explained in more detail below by way of drawings of examples of its realisation. In the drawings show.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

In the present application, the designations "up" and "down", "in the same height" as well as "horizontal" and "vertical" refer to an arrangement of the multichannel pipette wherein the pipette tips clamped onto the spigots are aligned vertically and with their syringe openings downward, in order to pick up a liquid from a vessel arranged underneath or to deliver it into the vessel.

All realisation examples refer to multichannel pipettes wherein the contact elements of the ejector are stop elements at the same time. Below, the contact elements are designated as stop elements.

Figure 1:
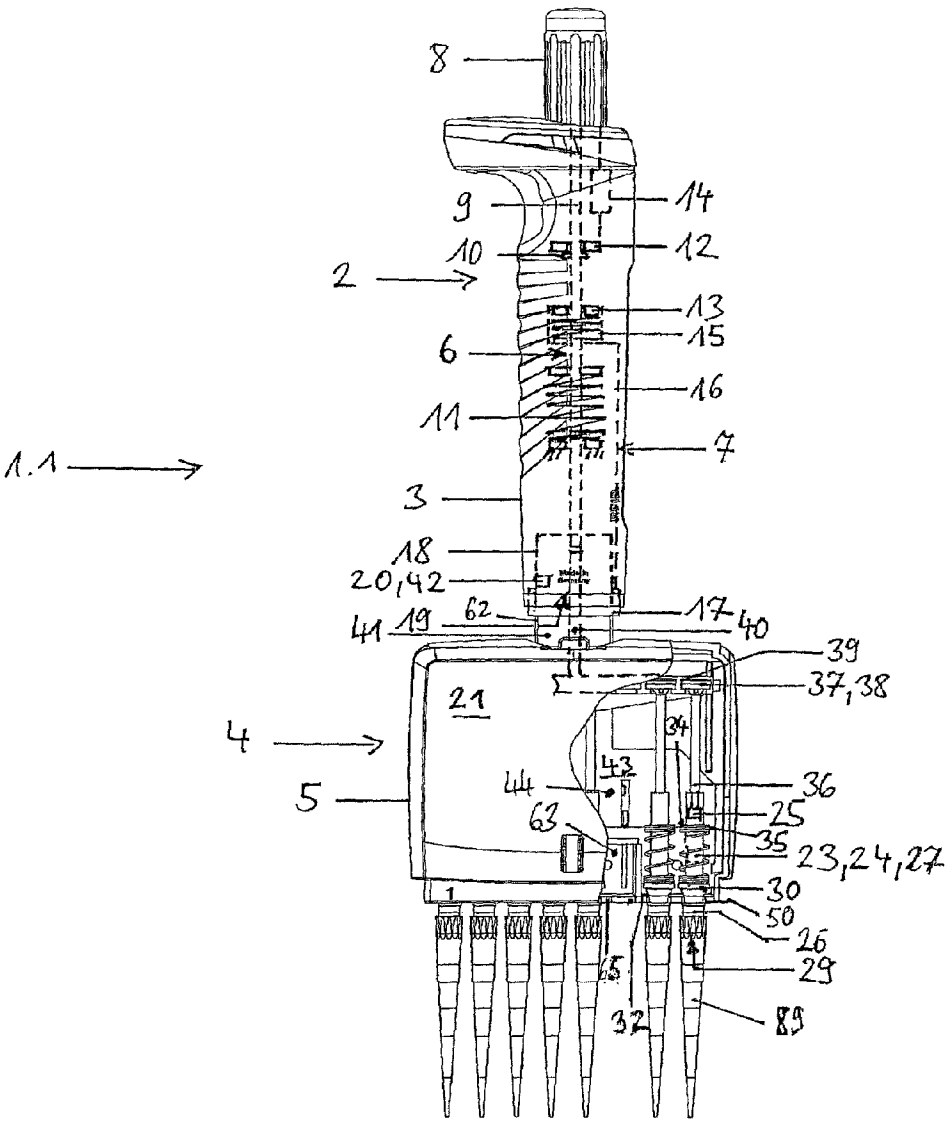
FIG. 1 a multichannel pipette with single-button operation, in a view from the front side, the delivery head being partially broken up.
Figure 2:
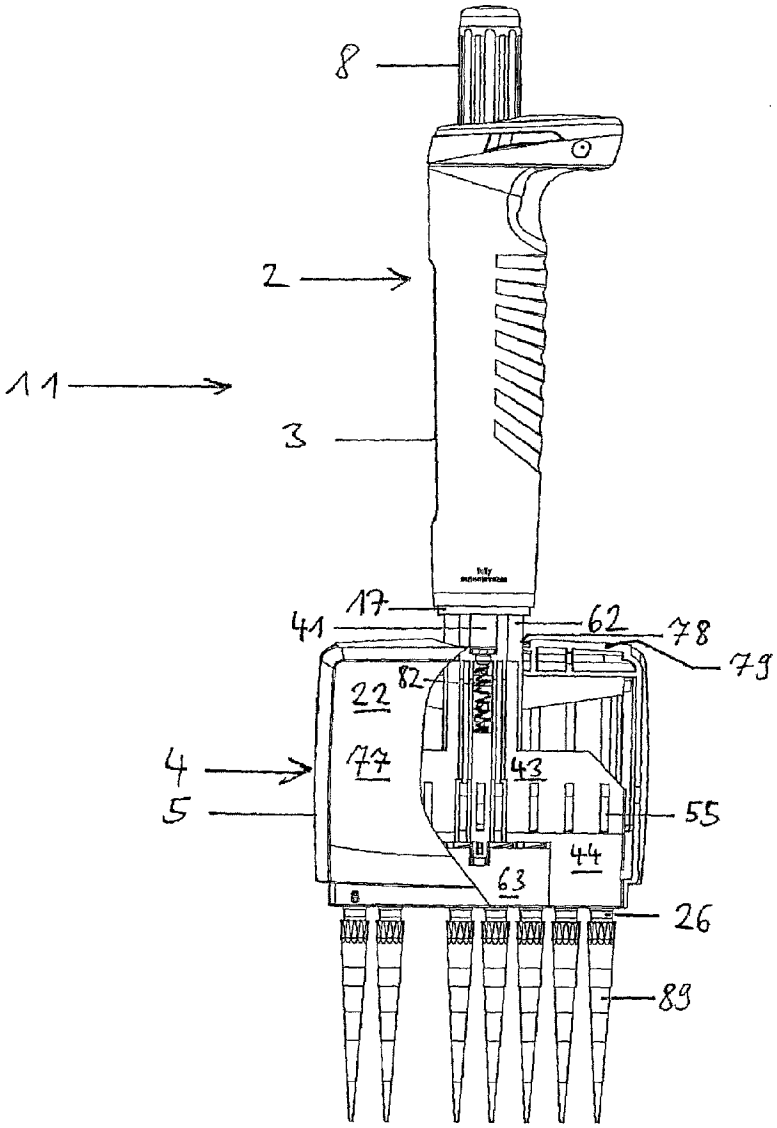
FIG. 2 the same multichannel pipette in a rear view, the delivery head being partially broken up.
Figure 3:
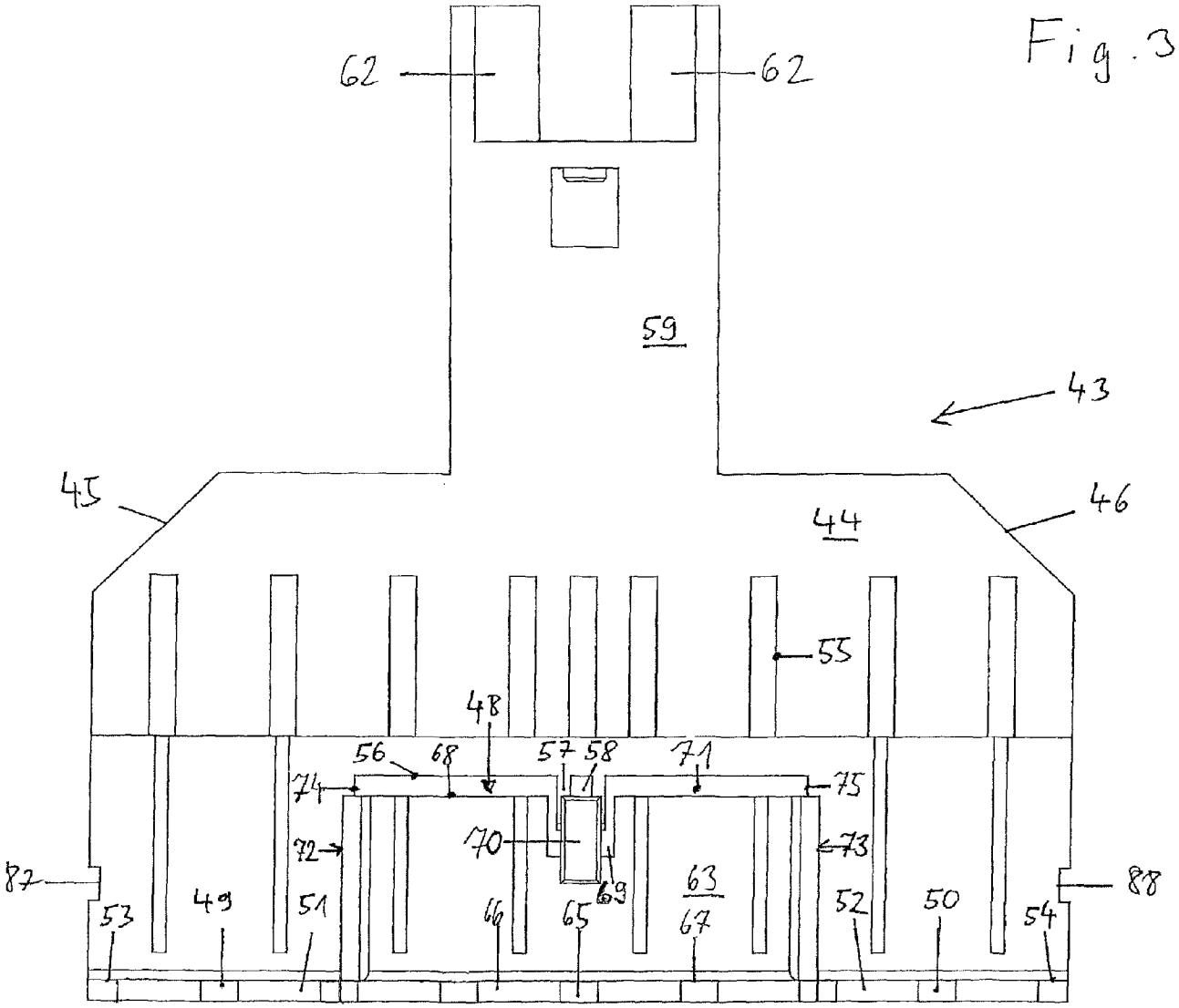
FIG. 3 the ejector of the same multichannel pipette in a magnified front view.
Figure 4:
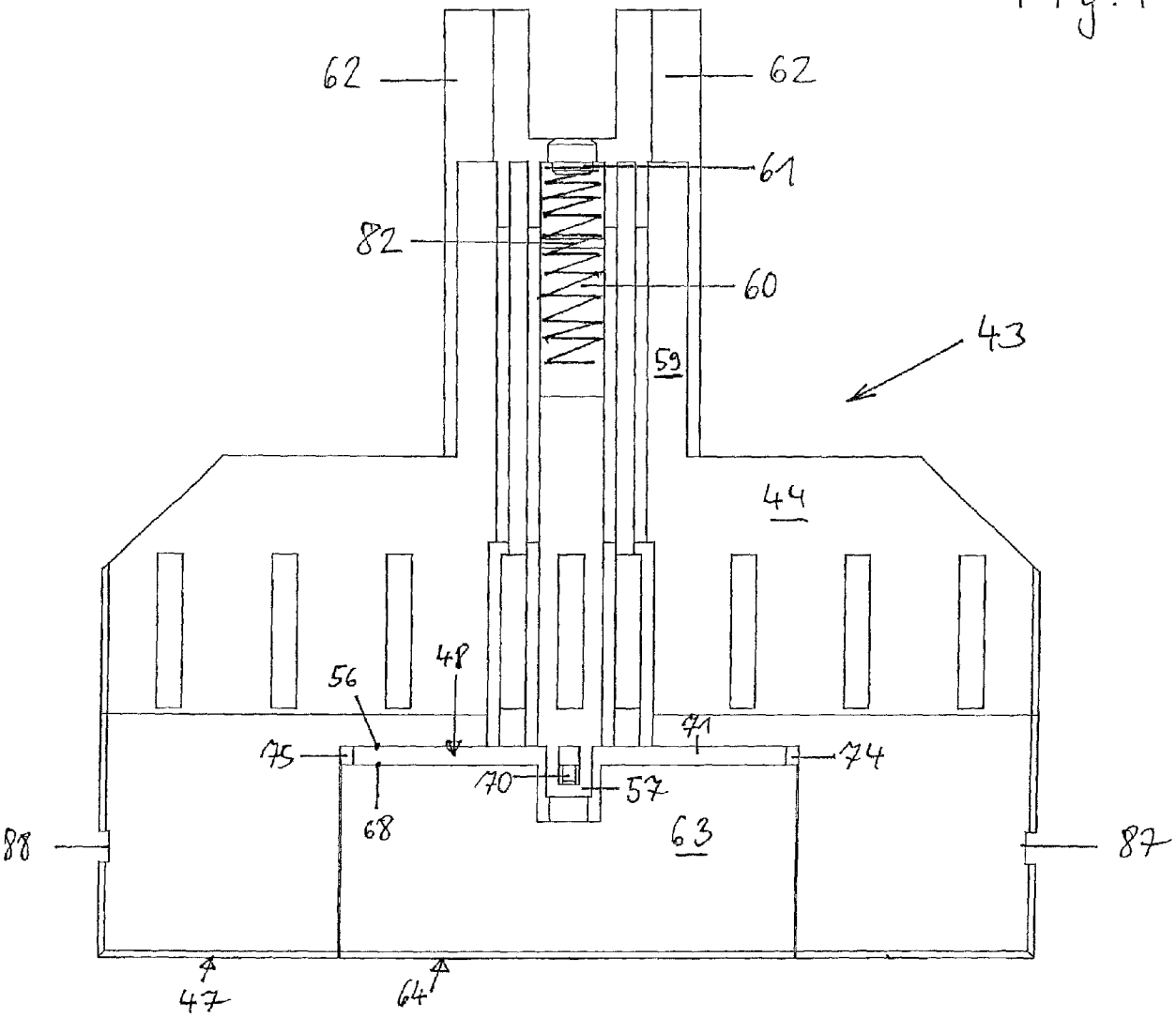
FIG. 4 the same ejector in a magnified rear view.
Figure 5:
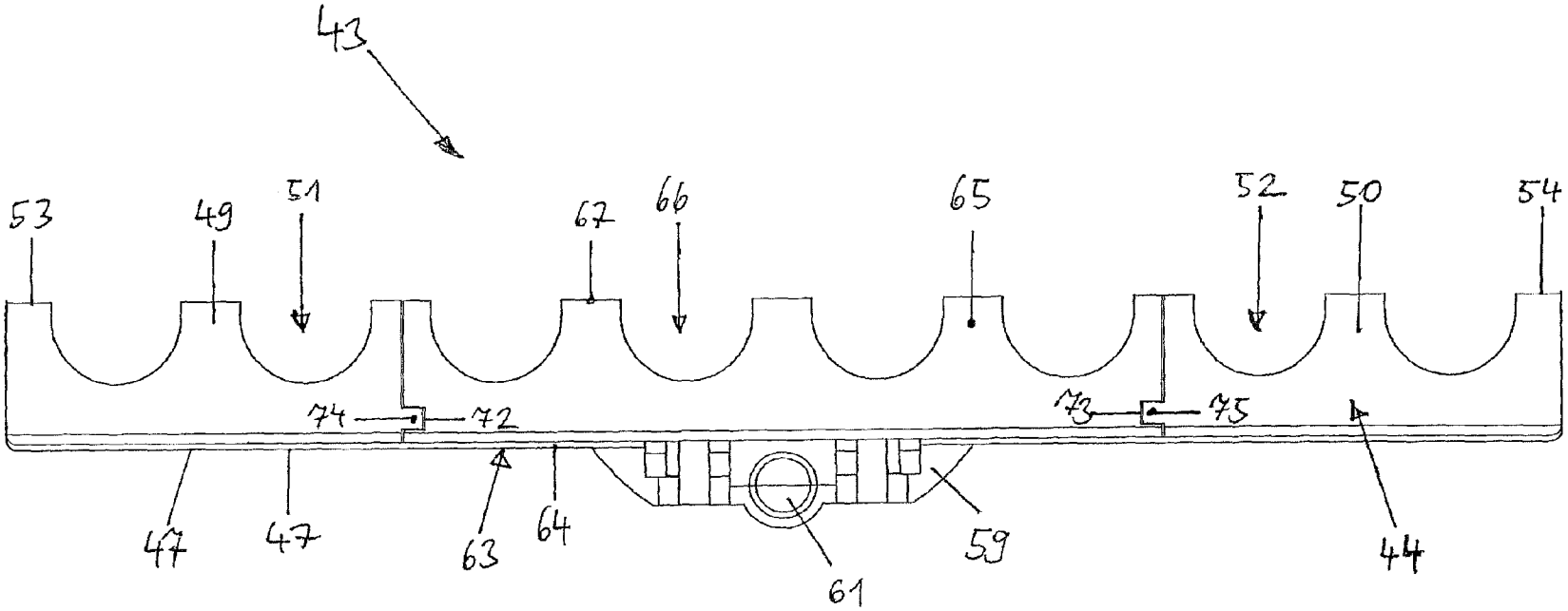
FIG. 5 the same ejector in a magnified bottom view.
Figure 6:
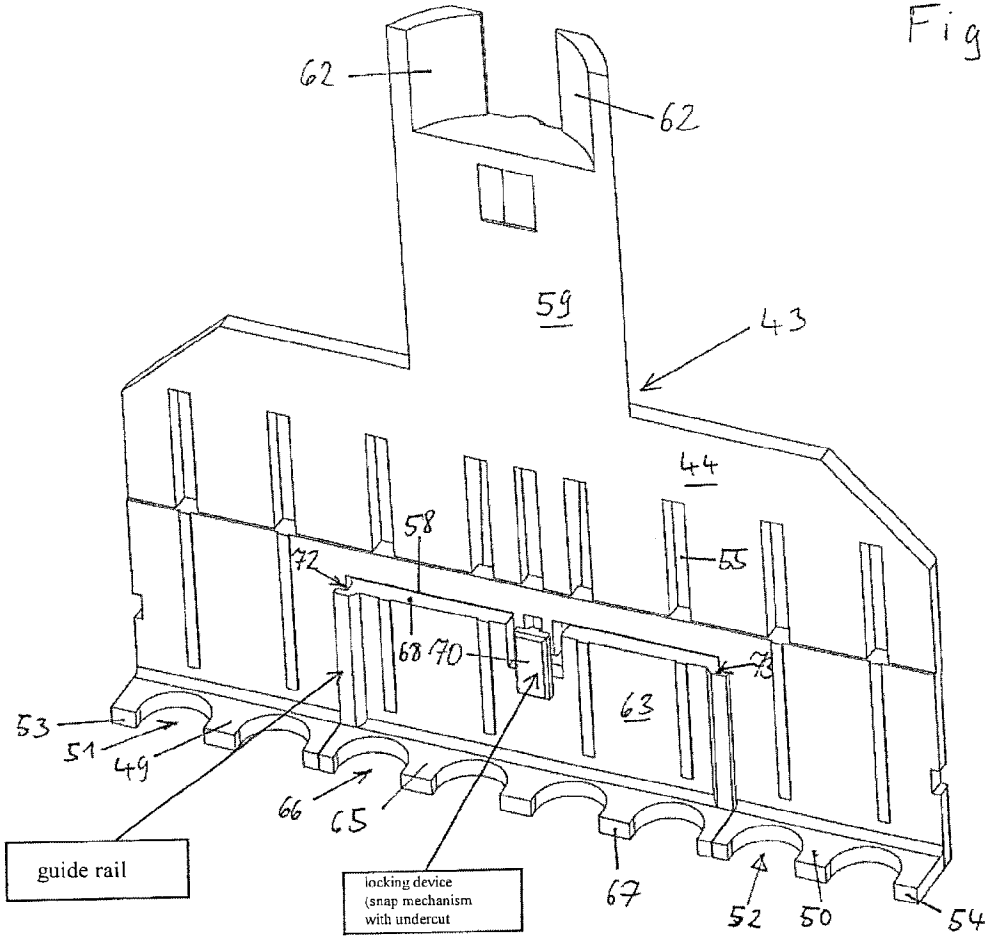
FIG. 6 the same ejector in a perspective view at an angle from the front and from the side.
Figure 7:
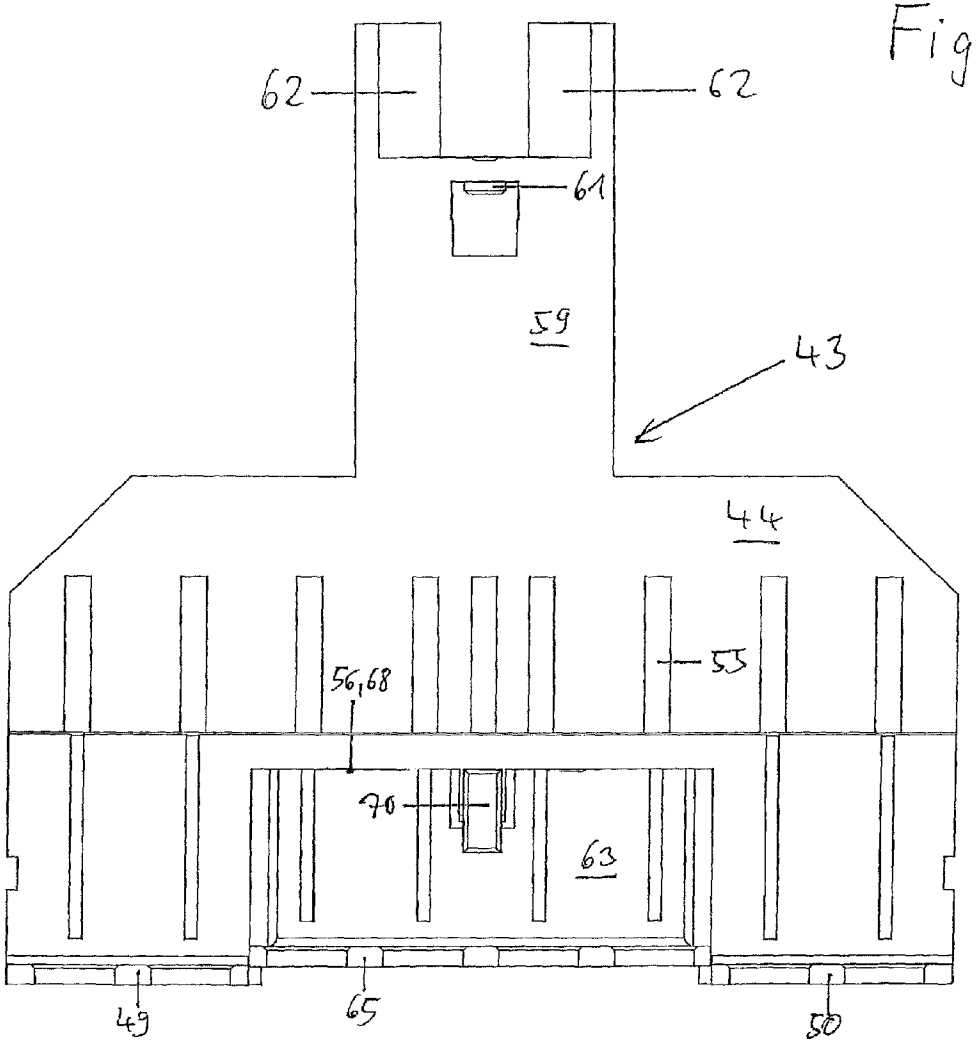
FIG. 7 the same ejector with the take-along means of the two ejector parts snugly fitting to each other, in a front view.
Figure 8:
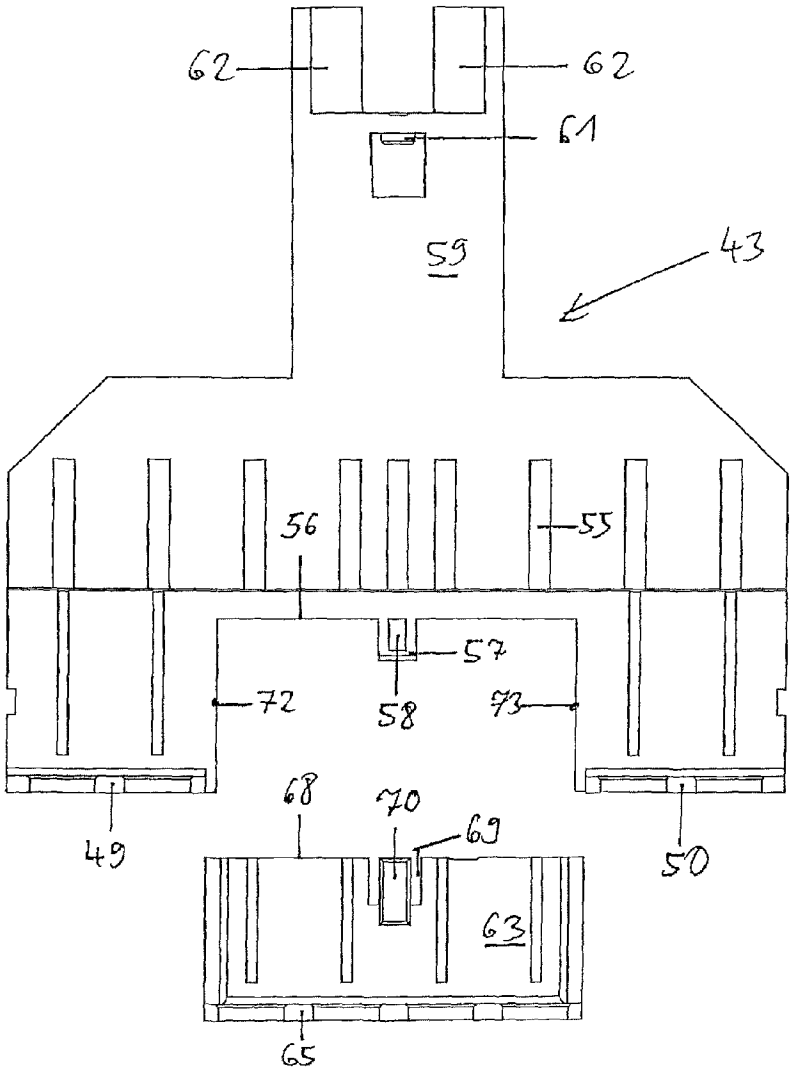
FIG. 8 the same ejector disassembled into its ejector parts in a front view.

According to FIGS. 1 and 2, a multichannel pipette 1.1 has a pipette upper part 2 with an upper casing part 3 and a pipette lower part 4 with a lower casing part 5. The upper casing part 3 is formed as a handle or shaft-shaped. The lower casing part 5 has essentially the form of a flat box. Upper casing part 3 and lower casing part 5 are together a base body.

The pipette upper part 2 comprises a first drive device 6 for displacement equipments, and a second drive device for an ejector.

The first drive device 6 comprises a dosing button 8, projecting from the upper casing part 3 at the topside and arranged so as to be dislocatable in the upper casing part in the longitudinal direction. At its bottom, the dosing button 8 is coupled to a lifting rod 9, which has a circulating bead 10 on the circumference. The lifting rod 9 is adapted to be dislocated in its longitudinal direction by actuating the dosing button 8 against the action of a pull-back spring 11.

The dislocation of the lifting rod 9 is limited by an upper stop 12 and a lower stop 13. The upper stop 12 can be adjusted in the longitudinal direction of the upper casing part 3. The dosing button 8 is coupled to the upper stop 12 via a gear system, so that the upper stop 12 is adjustable in the longitudinal direction of the upper casing part 3 by turning the dosing button 8.

The lower stop 13 is held in the upper casing part 3 by a spring device 15. After the impingement of the bead 10 on the lower stop 13, the spring device 15 (also called "overstroke spring") permits a further downward dislocation of the lifting rod 9 under increased effort, in order to perform an overstroke and an ejection stroke.

Further, a transmission device 16 is arranged in the upper casing part 3, which transmits a dislocation of the lifting rod 9 in the ejection stroke to a downward dislocation of an ejector sleeve 17, which is arranged on the lower end of the upper casing part 3.

The upper casing part 3 has a hollow cylindrical fixture 18 at the bottom end, into which a sleeve-shaped holding element of the pipette lower part 4 can be inserted through an insertion opening 19 in the lower end. On the fixture 18, the pipette upper part 2 has first means 20 for detachable connection with the pipette lower part 4. The ejector sleeve 17 is arranged concentrically with respect to the fixture 18 and projects downward from the lower edge of the insertion opening 19. The lower end of the lifting rod 9 extends into the fixture 18 from the topside when the dosing button 8 is not pressed.

According to FIGS. 1, 2 and 9, 10, the pipette lower part 4 comprises a lower casing part 5, which is formed by a front- and a rear casing shell 21, 22, which are joined in a vertical plane. Eight parallel piston-cylinder devices 23 are arranged in a row. Each piston-cylinder device 23 has a cylinder 24 into which a piston 25 plunges in.

At the bottom, each cylinder 24 is integrally connected to a dosing component 27 with a spigot 26, which tapers in the downward direction. Each spigot 26 has a connection hole 28, which is connected at the top side to an inner space of the cylinder 24 in which the piston 25 is dislocatable, and which runs out at the bottom in an opening 29 in the lower end of the spigot 26.

Each dosing component 27 has a circulating projection 30 between the spigots 26 and the cylinders 24.

The circulating projections 30 of the dosing components 27 are supported on the upper edges of third through holes 31 in a horizontal lower wall 32 of the lower casing part 5. Farther at the top side, the cylinders 24 are guided through fourth through holes 33 of a horizontal support board 34 of the lower casing part 5.

On each cylinder 24 is guided a first spring element 35 implemented as a helical spring, which is supported at the bottom on the circulating projection 30, and at the top on the lower side of the support board 34.

The pistons 25 have a piston disc 37 on the upper end of a piston rod 36. The piston discs are held in piston disc fixtures 38 of a horizontally aligned crosshead 39. The crosshead 39 has a vertically upward projecting rod 40 at its top, which has a contact surface for the lower end of the lifting rod 9 of the pipette upper part 2 on the upper end.

A sleeve-shaped holding element 41 projects upward form the lower casing part 5, through which the rod 40 extends. The holding element 41 has second means for detachable connection 42, which are detachably connected to the first means 20 for detachable connection of the pipette upper part 2.

The components of the pipette lower part 4 described above are held in the front casing shell 21.

The pipette lower part 4 comprises further an ejector 43. According to FIGS. 3 to 9, the ejector 43 comprises a board-shaped, essentially rectangular first ejector part 44 with chamfers 45, 46 on the two upper corners. The first ejector part 44 has a centrally arranged, rectangular first deepening 48 on a straight-lined lower edge 47. On the lower edge 45, the first ejector part 44 has on both sides of the deepening 48 one first stop element 49, 50 at a time, which is formed by a horizontally aligned first bar, which has first through openings 51, 52 which are opened towards the front edge 53, 54 of the first stop element 49, 50.

Further, the first ejector part 44 has several parallel guide slots 55, which are aligned vertically towards its lower edge 47.

On the upper first edge 56 of the first deepening 48, the first ejector part 44 has centrally a downward projecting eyelet 57 with an elongate rectangular eyelet opening 58.

An actuating element 59 extends from the upper edge 56 of the first ejector part 44 and has the form of a shaft, which has a flat front side, falling in line with the front side of the first ejector part, and a rear side which is somewhat cylindrically forward arched with respect to the rear side of the first ejector part 44. In the forward arched front side, the actuating element 59 has a groove 60 extending in the longitudinal direction, which is limited by a first abutment 61 at the top.

At the topside, the actuating element 59 has two protruding, stripe-shaped transmission elements 62, which are hollow cylindrical in a horizontal section.

A board-shaped second ejector part 63 is inserted into the first deepening 48. On the lower edge 64, the second ejector part 63 has a second stop element 65, which is formed by a second bar having second through holes 66 which are opened towards the front edge 67 of the second bar. On the upper second edge 68 of the second ejector part 63, a small second deepening 69 exists centrally, over which projects a snap hook 70 which is connected to the front side of the second ejector part 63 below the second deepening 69.

The upper first edge of the first deepening 48 is a first take-along means 56, and the upper second edge of the second ejector part 63 a second take-along means 68. When the first stop element 49, 50 and the second stop element 65 are arranged in the same height, a gap 71 exists between the first and second take-along means 56, 68, which amounts to about 0.75 mm e.g. In this position, the snap hook 70 rests snugly on the lower edge of the eyelet opening 58.

The second ejector part 63 has one longitudinal groove 72, 73 at a time on both lateral edges. The first ejector part 44 engages with the two lateral edges 74, 74 of the first deepening 48 into the two longitudinal grooves 72, 73.

The ejector 43 is guided in the rear casing shell 22 of the lower casing part 5 on ribs 76 which project from the inner side of the rear wall 77 of the lower casing part 5. The ribs 76 engage into the guide slots 55.

The actuating element 59 is guided with the transmission elements 62 through bow-shaped slots 78 in a horizontal upper wall 79 of the rear casing shell 22. The rear wall 77 of the rear casing shell 22 has an outward arched rear wall part, into which the actuating element 59 is inserted with its forward arched side. On the inner side in the area of the arching, the rear wall 77 comprises a second abutment. Between the second abutment and the first abutment 61 of the fastening element 59, a second spring element 82 realised as a helical spring is held under preload in the groove 60, which loads the ejector 43 so that the ribs 76 rest on the lower end of the guide slots 55.

Two side walls 83, 84 of the rear casing shell 22 have small, projecting withholding elements 86, which project somewhat beyond the lateral edges of the first ejector part 44. The first ejector part 44 has two small lateral deepenings 87, 88. The first ejector part 44 is thrust onto the withholding elements 86 with the lateral deepenings 87, 88 and is held by the second spring element 82 in a position wherein the withholding elements 85, 86 sit snugly on the first ejector part 44 below the lateral deepenings 44.

Thus, the ejector is held in the slots 78 on the top, and on the bottom by the withholding elements 85, 86 in the rear casing shell 22.

When the front casing shell 21 and the rear casing shell 22 are assembled, the first and second stop elements 49, 50, 65 sit snugly on the lower wall 32 of the lower casing part 5 at their bottoms, and the transmission elements 62 sit snugly on the holding element 41 at the outside.

In the assembled condition of pipette upper part 2 and pipette lower part 4, the first and second means for detachable connection 20, 42 are detachably connected one to another. On its bottom, the lifting rod 9 sits snugly on the upper end of the rod 40. The ejector sleeve 17 sits snugly on the upper end of the transmission element 62.

The multichannel pipette 1.1 can be used in the following way:

If needed, the dosing volume is adjusted by means of the dosing button 8.

Figure 9:
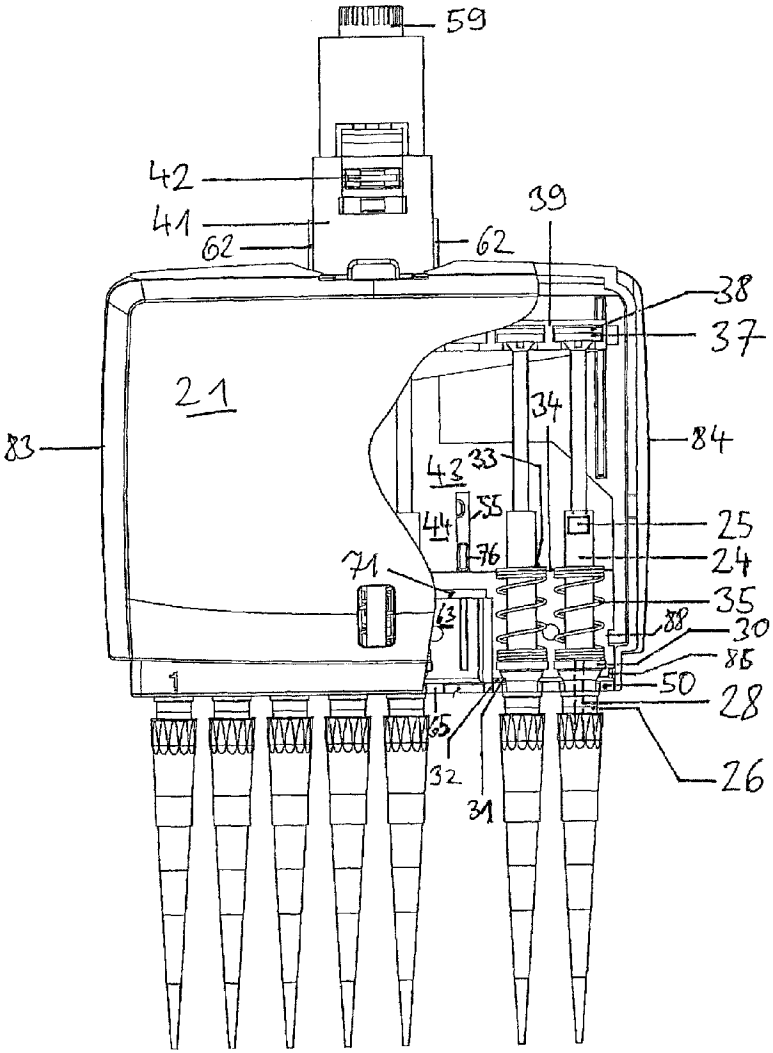
FIG. 9 the delivery head of the same multichannel pipette in a partially broken up, magnified front view.

Further, the multichannel pipette 1.1 is put with the spigots 26 into the plug-on openings of pipette tips 89, which are provided in a holder. In this, the first and second stop elements 49, 50, 65 of the ejector 43 are situated in stopping position in the same height as shown in FIGS. 1, 2 and 9. The first spring elements 35 are compressed by the clamping forces, until the pipette tips 89 sit snugly on the first and second stop elements 49, 50, 65 at the bottom. Thereafter, the multichannel pipette 1.1 with the clamped pipette tips is lifted, and the spigots 26 revert into the starting position of FIGS. 1, 2 and 9.

The dosing button 8 is subsequently pressed until an increased resistance is perceptible when the bead 10 impinges on the lower stop 13. In this, the lifting rod dislocates the pistons 25 downward against the action of the first spring elements 35 via the rod 40 and the crossbar 39, so that air is pressed out of the pipette tips. Subsequently, the pipette tips are concomitantly dipped into vessels, and thereafter the dosing button 8 is released. The pull-back spring 11 dislocates the lifting rod 9 back into the starting position, and the first spring elements 35 dislocate the pistons 25 back into the starting position. Liquid is aspirated from the vessels into the pipette tips 89 through this.

For the delivery of the picked-up liquid, the pipette tips 89 are directed to other vessels. Subsequently, the dosing button 8 is pressed until the bead 10 hits the lower stop 13. By further pressing the dosing button 8 against the action of the spring device 15, an overstroke for the delivery of residual amounts is effected at first. The user feels the end of the overstroke by a further increased resistance due to the action of the second spring element 82 in the beginning of the ejection stroke. By further pressing the dosing button 8, an ejection stroke is effected, in which the transmission device 16 dislocates the ejector sleeve 17 downward. In this, the ejector sleeve 17 dislocates the transmission elements 62 downward, and the ejector 43 is pushed downward against the action of the second spring element 82.

Figure 10:
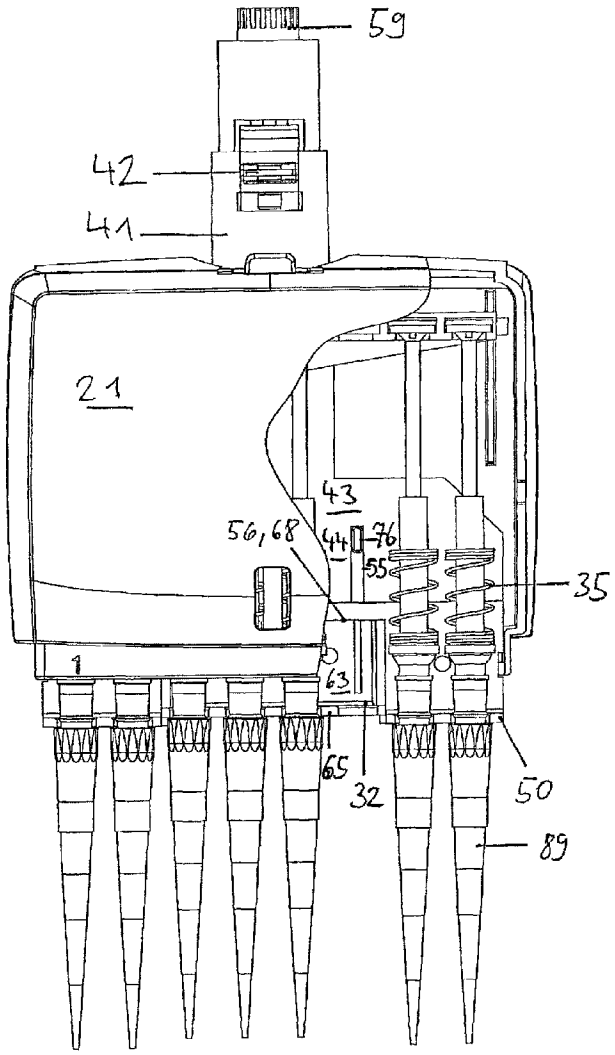
FIG. 10 the same delivery head at actuated ejector in a magnified, partially broken up front view.

When the ejector 43 hits the pipette tips 89 with the stop elements 49, 50, 65, the pipette tips 89 on the lugs beneath the second ejector part 63 block a further downward dislocation of the second ejector part 63. Upon further actuation of the dosing button 8, only the first ejector part 44 is dislocated farther downward and squeezes the two outer groups of pipette tips 89 off from the spigots beneath the first stop elements 49, 50. Finally, the first and second take-along means 56, 68 collide, and through this, the second ejector part 63 is moved farther downward also, so that the second stop element 65 squeezes the intermediate group of pipette tips 89 arranged thereunder off from the spigots 26. FIG. 10 shows the ejector 43 in the beginning of the squeeze-off of the intermediate group.

After unloading the dosing button 8, the pull-back spring 11 presses the dosing button 8 via the lifting rod 9. According to one embodiment, the pull-back spring 11 pushes also the ejector sleeve 17 back into the upper position via the transmission device 16. Alternatively, the transmission device 16 has an own pull-back spring, which moves the transmission device 16 and the ejector sleeve 17 back into the upper position. Even the spring device 15 occupies its starting condition again. The second spring element 82 dislocates the ejector 43 back into the starting position of FIGS. 1, 2 and 9.

Figure 11:
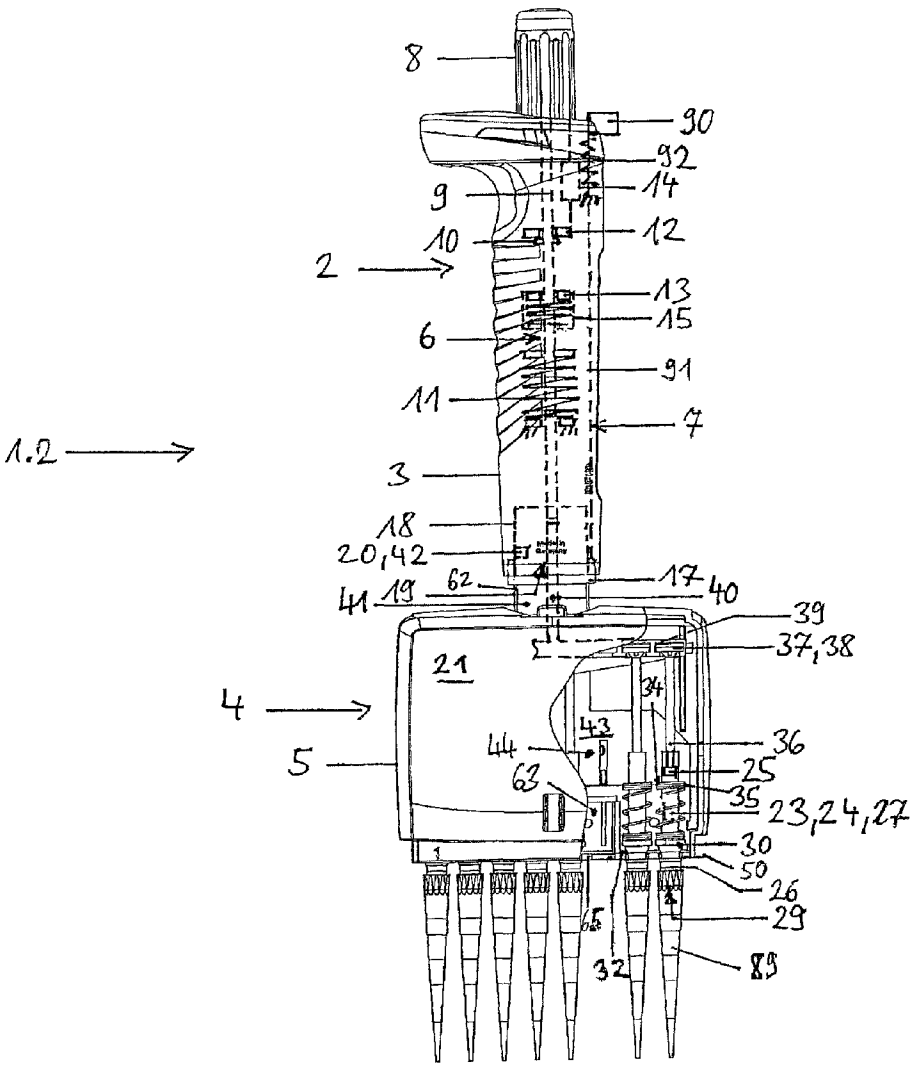
FIG. 11 a multichannel pipette with two-button operation in a front view, the delivery head being partially broken up.
Figure 12:
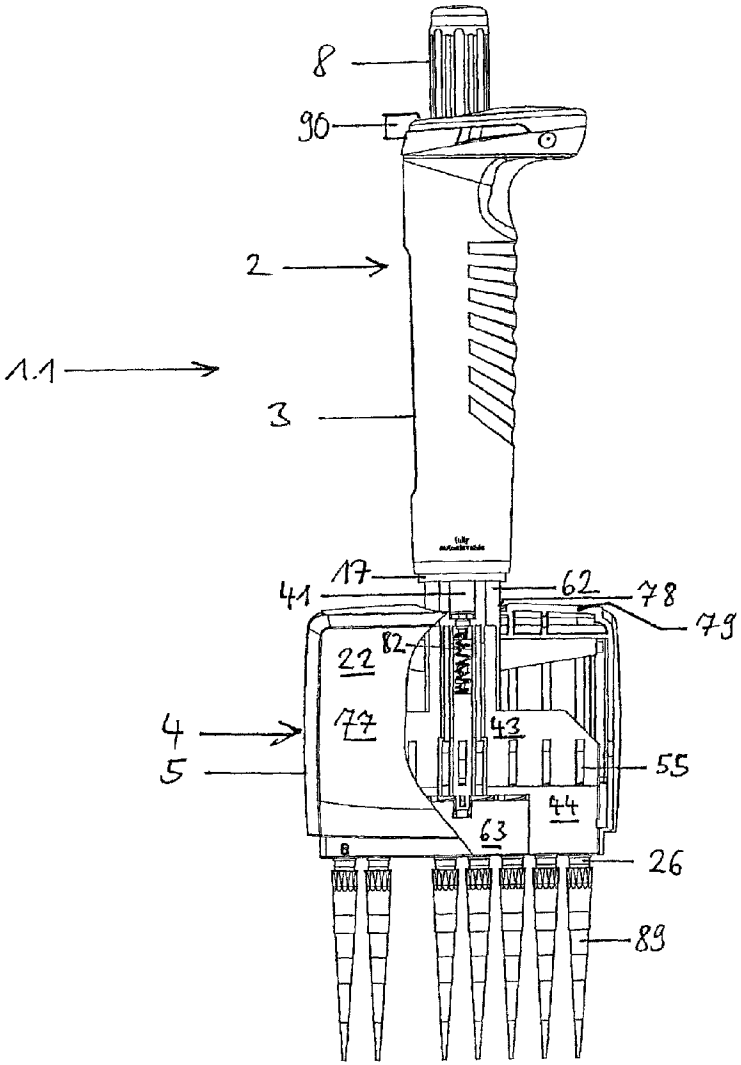
FIG. 12 the same multichannel pipette in a rear view, the delivery head being partially broken up.

The multichannel pipette 1.2 of FIGS. 11 and 12 differs from that described above in that it has a two-button operation. In the two-button operation, the dosing button 8 controls only the pick-up and the delivery of liquid, and an additional ejector button 90 triggers the ejector 43. For this purpose, the multichannel pipette 1.2 has an ejector button 90 projecting upward from the upper casing part 3 at the upper end, which is connected on its bottom to an ejector rod 91 that is guided so as to be dislocatable in the longitudinal direction of the casing. At its bottom, the ejector rod 91 is connected to the ejector sleeve 17 for its part.

An ejection spring 92 engages on the ejector rod 91 or on the ejector button 90 and a stationary point in the upper casing part 3, so that the ejector button 90 can be pressed against the action of the ejection spring 92.

The operation of this multichannel pipette 1.2 differs from the operation of the multichannel pipette 1.2 described above only in that the ejector button 90 must be pressed for throwing off the pipette tips 89. Through this, the ejector sleeve 17 is dislocated downward, whereby the transmission elements 62 of the ejector 43 are dislocated downward.

After unloading the ejector button 90, the ejection spring 92 places the ejector button 90 and the ejector rod 91 back into the upper starting position. Further, the second spring element 82 places the ejector 43 in the delivery head 4 back into the starting position.

Figure 13:
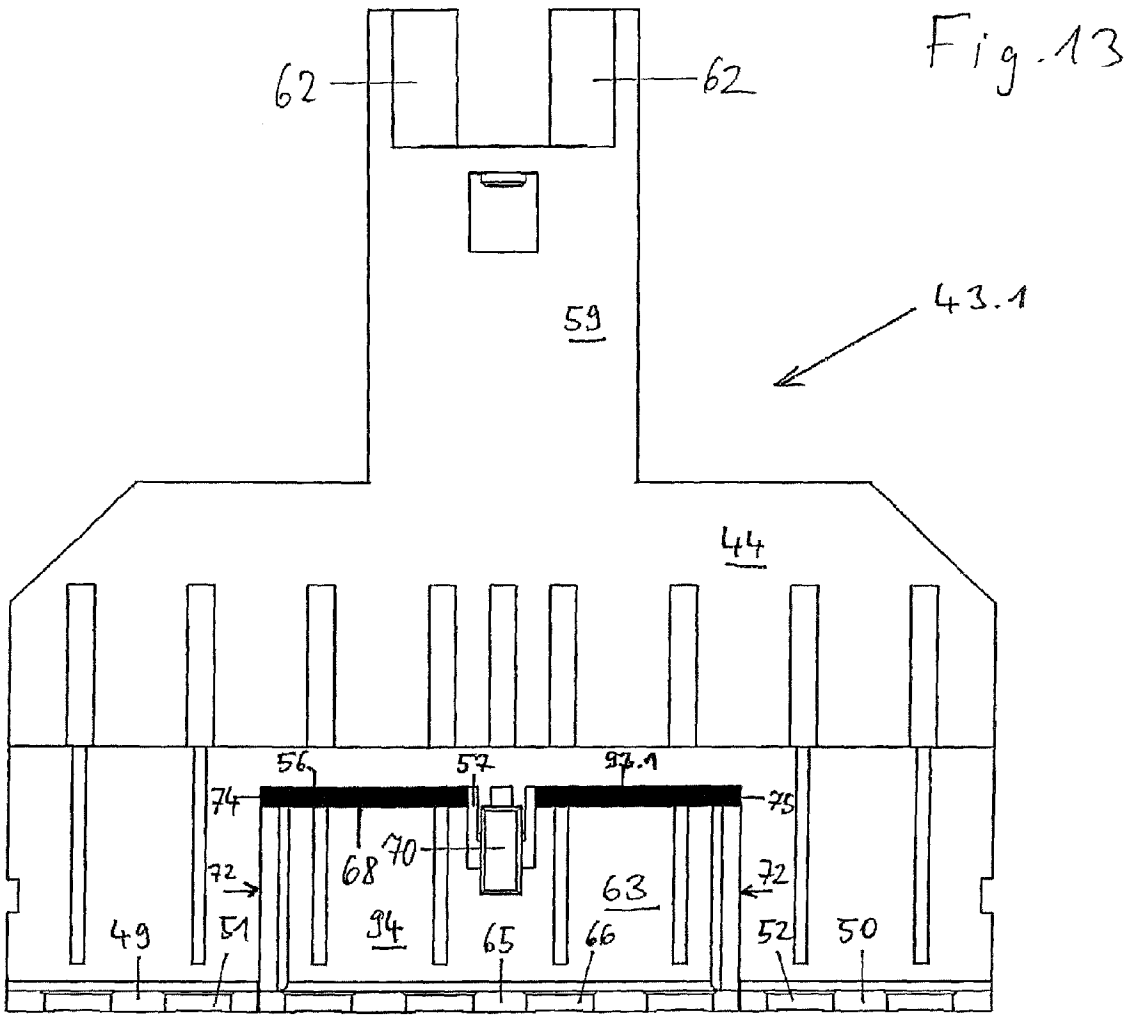
FIG. 13 an alternative ejector with partially soft elastic second ejector part in a magnified front view.
Figure 14:
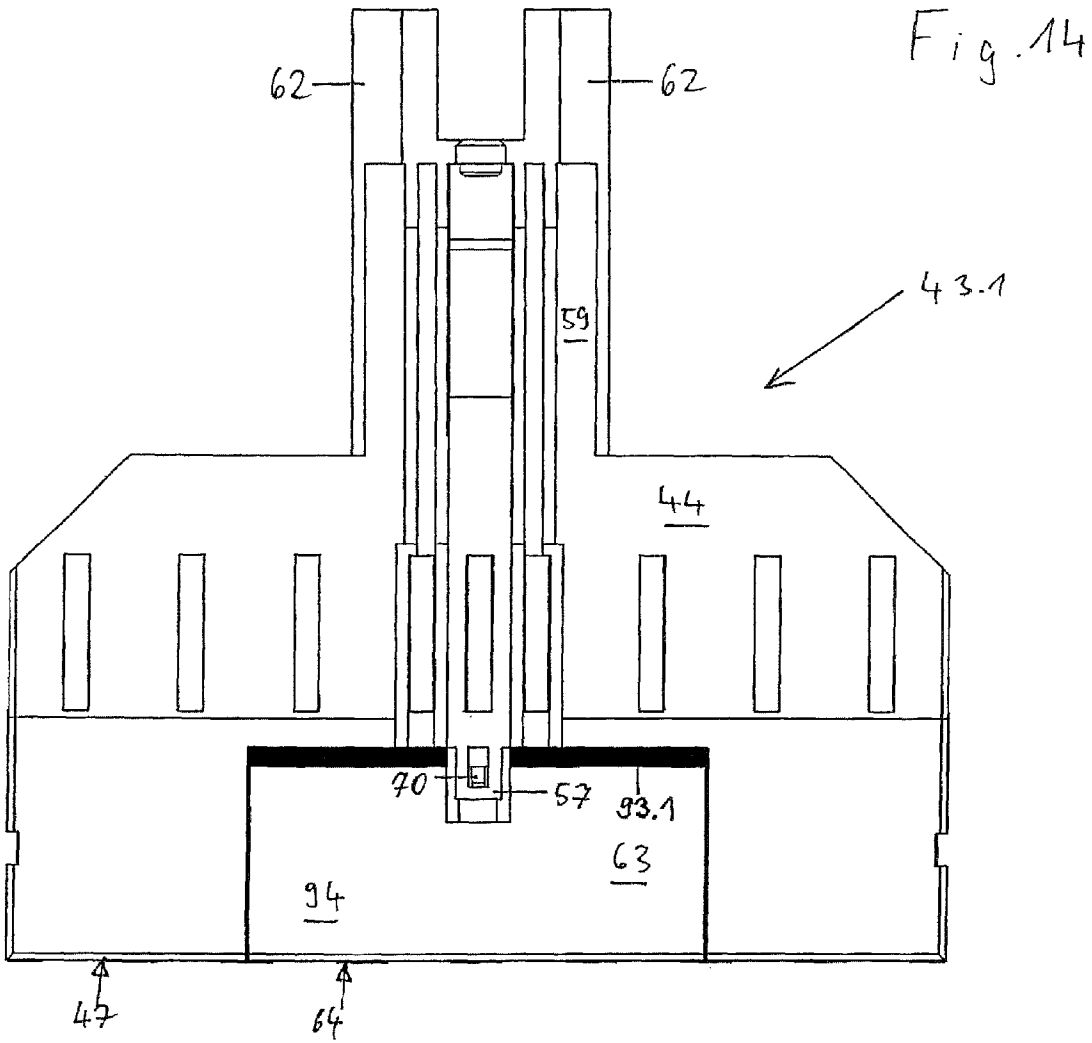
FIG. 14 the same ejector in a magnified rear view.

The ejector 43.1 of FIGS. 13 and 14 differs from the ejector 43 described above in that a stripe-shaped section 93.1 of a soft elastic material is moulded onto the upper second edge 68 of the second ejector part 63. The stripe-shaped section 93.1 sits snugly on the upper first edge 56 of the first ejector part 44 with its upper edge. In this arrangement, the second ejector part 63 is held without clearance by the snap hook 70 snapped into the eyelet 57.

The ejector 41.1 can be assembled into the multichannel pipette 1.2, 1.2 described above like the ejector 43 described above. In the plugging and the ejection of pipette tips 89 onto and from the spigots 26, the ejector 43.1 acts like the ejector 43. In the ejection of the pipette tips 89, the stripe-shaped section 93.1 is compressed in the vertical direction at first, until the spring force acting in the stripe-shaped section 93.1 is strong enough to squeeze the intermediate group of pipette tips 89 off from the spigots 26. In this, the lower board-shaped section 94 of the second ejector part 63, which consists of rigid material, is guided by the longitudinal grooves 72, 73 on the lateral edges 74, 75 of the first ejector part 44 (corresponding to FIG. 5).

Figure 15:
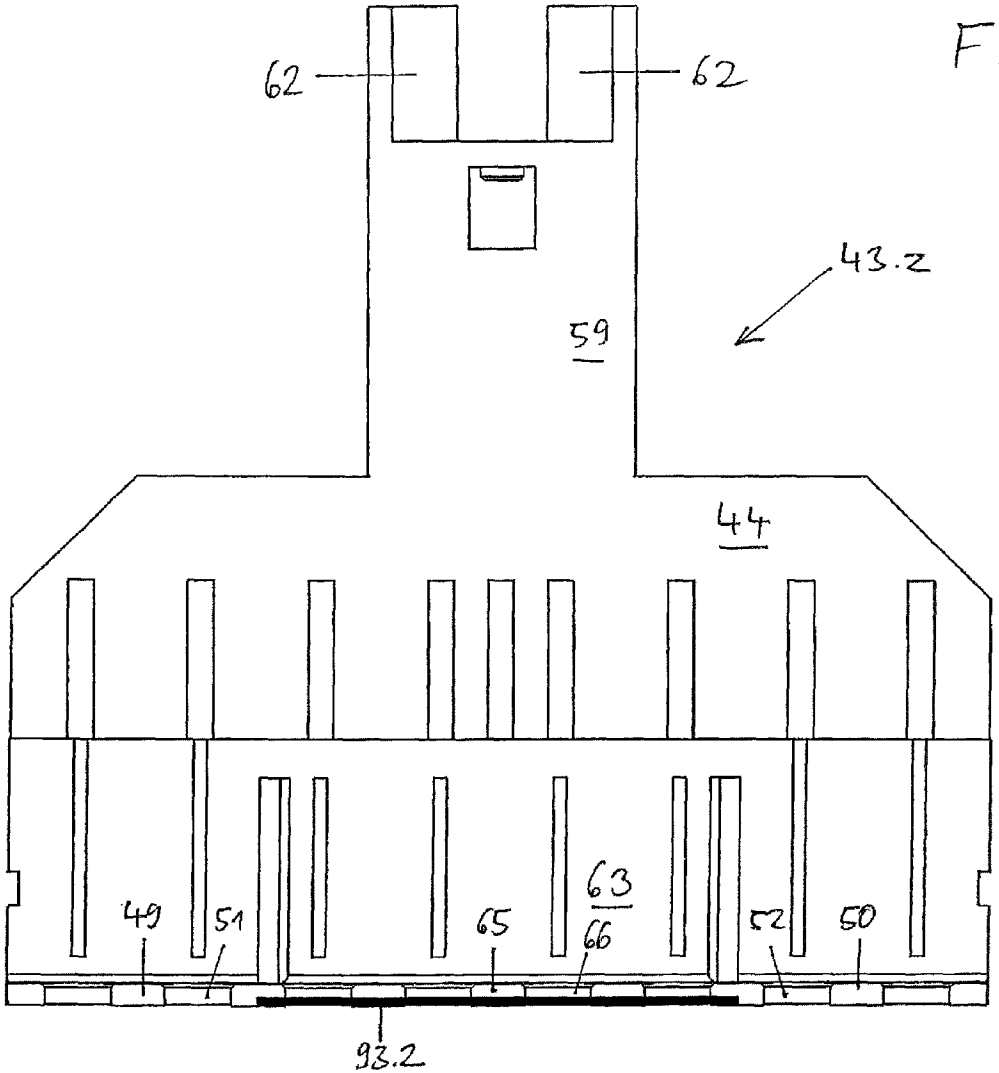
FIG. 15 another alternative ejector with partially elastic second ejector part in a magnified front view.
Figure 16:
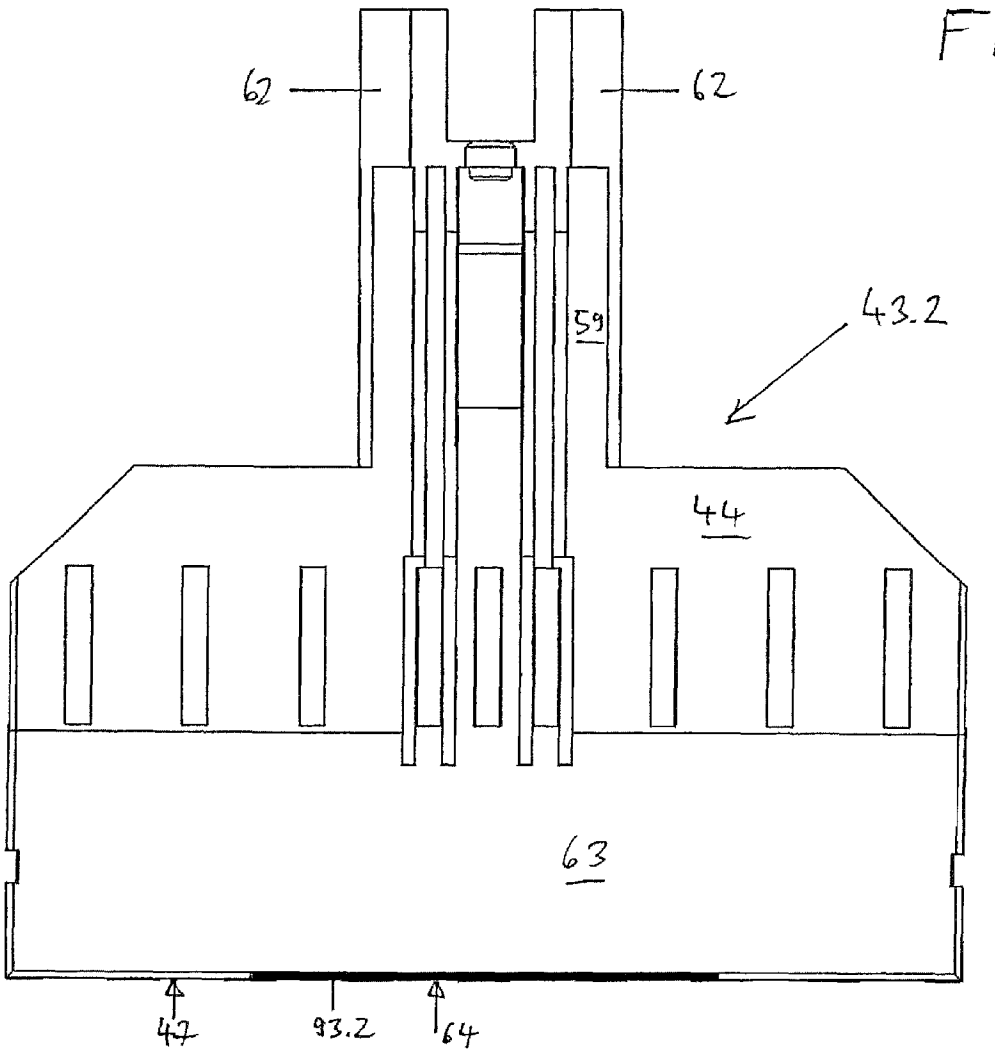
FIG. 16 the same ejector in a magnified rear view.

The ejector 43.2 of FIGS. 14 and 15 differs from the ejector 43 in that the second ejector part 63 comprises a stripe-shaped section 93.2 from a soft elastic material on the lower edge 64. The stripe-shaped section 93.2 exposes the second through holes 66, so that the spigots 26 can be guided through the second through holes 66. The stripe-shaped section 93.2 forms the second stop element 65 and the second contact element at the same time. For the rest, the second ejector part 63 is formed integrally with the first ejector part 44.

The ejector 43.2 can be assembled into a multichannel pipette 1.1, 1.2 like the ejector 43. In the plugging onto and the ejection of pipette tips 89 from the spigots 26, the ejector 43.2 acts like the ejector 43. In the ejection, the stripe-shaped section 93.2 is compressed at first when it strikes the intermediate group of pipette tips 86. When the elastic pull-back forces have increased sufficiently in the stripe-shaped section 93.2, the stripe-shaped section 93.2 or the second ejector 43.1, respectively, squeezes the intermediate group of pipette tips off from the spigots 26.

This completes the description of the preferred and alternate embodiments of the invention. Those skilled in the art may recognize other equivalents to the specific embodiment described herein which equivalents are intended to be encompassed by the claims attached hereto.

LIST OF THE REFERENCE SIGNS

1.1, 1.2 multichannel pipette
2 pipette upper part
3 upper casing part (base body)
4 pipette lower part (delivery head)
5 lower casing part (base body)
6 first drive device
7 second drive device
8 dosing button
9 lifting rod
10 bead
11 pull-back spring
12 upper stop
13 lower stop
14 gear system
15 spring device
16 transmission device
17 ejector sleeve
18 fixture
19 insertion opening
20 first means for detachable connection
21 front casing shell
22 rear casing shell
23 piston-cylinder-device
24 cylinder
25 piston
26 spigot
27 dosing component
28 connection hole
29 opening
30 circulating projection
31 third through hole
32 lower wall
33 fourth through hole
34 support board
35 first spring element
36 piston rod
37 piston disc
38 fixture for piston disc
39 crosshead
40 rod
41 holding element
42 second means for detachable connection
43, 43.1, 43.2 ejector
44 first ejector part
45, 46 chamfer
47 lower edge
48 first deepening
49, 50 first stop element (first bar)
51, 52 first through hole
53, 54 front edge
55 guide slot
56 first take-along means (upper first edge)
57 eyelet
58 eyelet opening
59 actuating element
60 groove
61 first abutment
62 transmission element
63 second ejector part
64 lower edge
65 second stop element (second bar)
66 second through hole
67 front edge
68 second take-along means (upper second edge)
69 second deepening
70 snap hook
71 gap
72, 73 longitudinal groove
74, 75 lateral edge
76 rib
77 rear wall
78 slot
79 upper wall
82 second spring element
83, 84 side wall
86 withholding element
87, 88 lateral deepening
89 pipette tip
90 ejector button
91 ejector rod
92 ejection spring
93.1, 93.2 stripe-shaped section
94 board-shaped section.

What is claimed is:

1. A multichannel pipette comprising:

a base body (5), several spigots (26) for clamping up pipette tips (89), arranged parallel side by side in a row, protruding from the base body (5) and mounted on the base body so as to be movable in their longitudinal direction, at least one displacement equipment (23) with a displacement chamber (24) and a displacement member (25) dislocatable therein, wherein the displacement chamber (23) is connected to connection holes (28) in the spigots (26) in order to eject or aspirate air through openings (29) of the connection holes (28) in lower ends of the spigots (26), a first drive device (6), connected to the displacement member (25) and adapted to dislocate the displacement member (25) in the displacement chamber (24), first spring elements (35) engaging on the spigots (26) and on the base body (5), wherein the spigots (26) are dislocatable upward in their longitudinal direction from a starting position against the spring action of the first spring elements (35), at least one stop element (49, 50, 65), having a defined stop position in which the spigots (26) protrude downward from the stop element (49, 50, 65), wherein the first spring elements (35) are designed such that by defined clamping forces which can be applied by clamping up pipette tips (89) onto the spigots (26), the spigots (26) can be dislocated towards the stop element (49, 50, 65) in the stop position in such a way that the pipette tips (89) hit the stop element (49, 50, 65), and an ejection equipment for detaching pipette tips (89) from the spigots (26), comprising an ejector (43), which comprises contact elements (49, 50, 65), means for mounting the ejector (43) on the base body (5) so as to be slidable in the longitudinal direction of the spigots (26) and a drive device connected to the ejector (43) and which is adapted to dislocate the ejector downward in the longitudinal direction of the spigots (26) from out a starting position, in which pipette tips (89) can be clamped up onto the spigots (26) until they strike the stop element (49, 50, 65) in the stop position, in order to squeeze pipette tips (89) off from the spigots (26) by the contact elements (49, 50, 65), wherein the ejector (43) has the contact elements (49, 50, 65) on different ejector parts (44, 63) and is designed such that in the downward dislocation of the ejector (43), at least after the impact of at least one first contact element (49, 50) on pipette tips (89), at least one second contact element (65) pursues the first contact element (49, 50) in order to squeeze one or several pipette tips (89) off from the spigots (26) by the first contact element (49, 50) at first, and thereafter one or several pipette tips (89) by the second contact element (65), said ejector describing three states, a first state as a stop position in which pipette tips are clamped to spigots and all stop elements are the same height, a second state wherein the first contact elements contact one or several pipette tips and squeezes them off from the spigots but the second contact elements do not squeeze the pipette tips off from the spigots, and a third state after the second state during the same downward dislocation of the ejector wherein the second contact elements contact one or several pipette tips and squeeze them off from the spigots.

2. A multichannel pipette comprising:

a base body (5), several spigots (26) for clamping up pipette tips (89), arranged parallel side by side in a row, protruding from the base body (5) and mounted on the base body so as to be movable in their longitudinal direction, at least one displacement equipment (23) with a displacement chamber (24) and a displacement member (25) dislocatable therein, wherein the displacement chamber (23) is connected to connection holes (28) in the spigots (26) in order to eject or aspirate air through openings (29) of the connection holes (28) in lower ends of the spigots (26), a first drive device (6), connected to the displacement member (25) and adapted to dislocate the displacement member (25) in the displacement chamber (24), first spring elements (35) engaging on the spigots (26) and on the base body (5), wherein the spigots (26) are dislocatable upward in their longitudinal direction from a starting position against the spring action of the first spring elements (35), at least one stop element (49, 50, 65), having a defined stop position in which the spigots (26) protrude downward from the stop element (49, 50, 65), wherein the first spring elements (35) are designed such that by defined clamping forces which can be applied by clamping up pipette tips (89) onto the spigots (26), the spigots (26) can be dislocated towards the stop element (49, 50, 65) in the stop position in such a way that the pipette tips (89) hit the stop element (49, 50, 65), and an ejection equipment for detaching pipette tips (89) from the spigots (26), comprising an ejector (43), which comprises contact elements (49, 50, 65), means for mounting the ejector (43) on the base body (5) so as to be slidable in the longitudinal direction of the spigots (26) and a drive device connected to the ejector (43) and which is adapted to dislocate the ejector downward in the longitudinal direction of the spigots (26) from out a starting position, in which pipette tips (89) can be clamped up onto the spigots (26) until they strike the stop element (49, 50, 65) in the stop position, in order to squeeze pipette tips (89) off from the spigots (26) by the contact elements (49, 50, 65), wherein the ejector (43) has the contact elements (49, 50, 65) on different ejector parts (44, 63) and is designed such that in the downward dislocation of the ejector (43), at least after the impact of at least one first contact element (49, 50) on pipette tips (89), at least one second contact element (65) pursues the first contact element (49, 50) in order to squeeze one or several pipette tips (89) off from the spigots (26) by the first contact element (49, 50) at first, and thereafter one or several pipette tips (89) by the second contact element (65), wherein the first and second ejector parts (44, 63) are board-shaped, the first contact element (49, 50) is at least one first bar, protruding horizontally from the lower edge of the first ejector part (44) and having one or plural first through hole(s) (51, 51), the second contact element (65) is at least one second bar, protruding horizontally from the lower edge of the second ejector part (63) and having one or plural second through hole(s) (66), and the spigots (26) penetrate the first and second through holes (51, 52, 66).

3. A multichannel pipette comprising:

a base body (5), several spigots (26) for clamping up pipette tips (89), arranged parallel side by side in a row, protruding from the base body (5) and mounted on the base body so as to be movable in their longitudinal direction, at least one displacement equipment (23) with a displacement chamber (24) and a displacement member (25) dislocatable therein, wherein the displacement chamber (23) is connected to connection holes (28) in the spigots (26) in order to eject or aspirate air through openings (29) of the connection holes (28) in lower ends of the spigots (26), a first drive device (6), connected to the displacement member (25) and adapted to dislocate the displacement member (25) in the displacement chamber (24), first spring elements (35) engaging on the spigots (26) and on the base body (5), wherein the spigots (26) are dislocatable upward in their longitudinal direction from a starting position against the spring action of the first spring elements (35), at least one stop element (49, 50, 65), having a defined stop position in which the spigots (26) protrude downward from the stop element (49, 50, 65), wherein the first spring elements (35) are designed such that by defined clamping forces which can be applied by clamping up pipette tips (89) onto the spigots (26), the spigots (26) can be dislocated towards the stop element (49, 50, 65) in the stop position in such a way that the pipette tips (89) hit the stop element (49, 50, 65), and an ejection equipment for detaching pipette tips (89) from the spigots (26), comprising an ejector (43), which comprises contact elements (49, 50, 65), means for mounting the ejector (43) on the base body (5) so as to be slidable in the longitudinal direction of the spigots (26) and a drive device connected to the ejector (43) and which is adapted to dislocate the ejector downward in the longitudinal direction of the spigots (26) from out a starting position, in which pipette tips (89) can be clamped up onto the spigots (26) until they strike the stop element (49, 50, 65) in the stop position, in order to squeeze pipette tips (89) off from the spigots (26) by the contact elements (49, 50, 65), wherein the ejector (43) has the contact elements (49, 50, 65) on different ejector parts (44, 63) and is designed such that in the downward dislocation of the ejector (43), at least after the impact of at least one first contact element (49, 50) on pipette tips (89), at least one second contact element (65) pursues the first contact element (49, 50) in order to squeeze one or several pipette tips (89) off from the spigots (26) by the first contact element (49, 50) at first, and thereafter one or several pipette tips (89) by the second contact element (65), wherein the ejector (43) has a first ejector part (44) which is connected to the drive device, and a second ejector part (63), wherein the first ejector part (43) and the second ejector part are guided by means for guiding (72, 73, 74, 75) so as to be dislocatable relative to each other in the longitudinal direction of the spigots (26), the first ejector part (44) with the first contact element (49, 50) and the second ejector part (63) with the second contact element (65) are arranged in the same height in the starting position of the ejector (43), and first take-along means (56) exist on the first ejector part (44) as well as second take-along means (68) on the second ejector part (63), which are spaced apart from each other in the starting position of the ejector (43) and can be moved against each other along the means for guiding (72, 73, 74, 75) in the downward dislocation of the ejector (43) by dislocation of the first ejector part (44) and the second ejector part (63) relative to each other, in order to dislocate the second ejector part (63) downward synchronously with the first ejector part (44) when the first and the second take-along means (56, 68) hit each other.

4. The multichannel pipette according to claim 3, wherein the contact elements (49, 50, 65) are stop elements and occupy the stopping position in the starting position of the ejector (43).

5. A multichannel pipette according to claim 3, wherein the distance between the first and second take-along means (56, 68) in the vertical direction is 0.1 to 3 mm, preferably 0.5 to 1.5 mm in the starting position of the ejector (43).

6. A multichannel pipette according to claim 3, wherein the first ejector part (44) has a first deepening (48) on its lower edge with first guide elements (74, 75) on two lateral edges, and wherein the second ejector part (63) is inserted into the first deepening (48) of the first ejector part (44) and is guided so as to be dislocatable in the longitudinal direction of the spigots (26) on second guide elements (72, 73) on two lateral edges on the first guide elements (74, 75) of the first ejector part (44).

7. The multichannel pipette according to claim 6, wherein the first take-along means (56) are formed by the upper edge of the deepening (48), and the second take-along means (68) are formed by the upper edge of the second ejector part (63).

8. A multichannel pipette according to claim 6, wherein the second ejector part (63) is held on the first ejector part (44) by snap connection means or other connection means (57, 70) which have a clearance in the longitudinal direction of the spigots (26).

9. The multichannel pipette according to claim 8, wherein the snap connection means have an eyelet (57) on the first ejector part (44), and a snap hook (70) engaging with clearance in the direction of the spigots (26) into the eyelet (57) on the second ejector part or vice versa.

10. A multichannel pipette according to claim 1, wherein the ejector (43.1, 43.2) has a rigid first ejector part (44) and an at least partially rigid second ejector part (63), and the first ejector part (44) with the first contact element (49, 50) and the second ejector part with the second contact element (65) are arranged in the same height in the starting position of the ejector (43.1, 43.2), so that when the ejector parts with the contact elements hit the pipette tips (89), the rigid first ejector part (44) squeezes pipette tips off from spigots at first, and the at least partially soft-elastic second ejector part (63) is blocked and elastically compressed by pipette tips (89), and after an increase of the force for compressing the at least partially soft-elastic second ejector part (63) to a value exceeding the force for ejecting the pipette tip (89) which rests on the second contact element (65), the pipette (89) tips resting on the second contact element (65) are ejected.

11. A multichannel pipette according to claim 1, wherein the means for dislocatable mounting (55, 76) of the ejector (43) have at least one guide slot (55) in the ejector (43) extending in the longitudinal direction of the spigots (26), and at least one guide element (76), fixedly connected to the base body (5) and engaging into the guide slot (55).

12. A multichannel pipette according to claim 1, wherein the ejector (43) has an actuating element (59) on the topside, protruding upward in the direction of the spigots (26).

13. A multichannel pipette according to claim 1, wherein in its starting position, the ejector rests with the first and second stop elements (49, 50, 65) or another ejector part on a counter stop element (32), arranged fixedly on the base body (5), which prevents the ejector from a dislocation farther upward.

14. The multichannel pipette according to claim 13, wherein the counter stop element (32) is a bottom wall of the base body (5) having third through openings, through which the spigots (26) project downward and on which the stop elements (49, 50, 65) rest at the bottom in the starting position.

15. A multichannel pipette according to claim 1, wherein the ejector (43) is dislocatable downward against the spring action of a second spring element (82) which engages on the ejector (43) and on the base body (5).

16. A multichannel pipette according to claim 1, wherein the number of the spigots (26) which project from the first stop element (49, 50) is the same as the number of the spigots (26) which project from the second stop element (65).

* * * * *